United States Patent [19]

Knox

[11] 4,140,426

[45] Feb. 20, 1979

[54] SYSTEM FOR INFLATING PACKERS AND PLACING GROUT THROUGH ONE LINE

[75] Inventor: Lloyd C. Knox, Duncan, Okla.

[73] Assignee: Halliburton Company, Duncan, Okla.

[21] Appl. No.: 844,415

[22] Filed: Oct. 21, 1977

[51] Int. Cl.[2] ..... E02D 5/00; E02D 5/14

[52] U.S. Cl. ..... 405/225; 405/224; 405/227

[58] Field of Search ..... 61/86–104, 61/63

[56] References Cited

U.S. PATENT DOCUMENTS

| | | | |
|---|---|---|---|
| 3,564,856 | 2/1971 | Blount et al. | 61/94 |
| 3,647,245 | 3/1972 | Hanes et al. | 61/63 X |
| 3,868,826 | 4/1975 | Landers | 61/102 |
| 4,009,581 | 3/1977 | Britton et al. | 61/100 X |
| 4,041,718 | 8/1977 | Stone | 61/98 X |
| 4,047,391 | 9/1977 | Mayfield et al. | 61/98 X |
| 4,063,421 | 12/1977 | Coone et al. | 61/102 |
| 4,063,427 | 12/1977 | Hoffman | 61/100 |
| 4,077,224 | 3/1978 | Coone | 61/94 |

*Primary Examiner*—Dennis L. Taylor

*Attorney, Agent, or Firm*—John H. Tregoning; James R. Duzan

[57] ABSTRACT

A method and apparatus for inflating a plurality of packers installed in off-shore platforms and grouting the annuli between the piles and pile sleeves thereon utilizing a single line and a control valve system for inflating the plurality of packers and grouting the annuli between the pile and pile sleeves.

42 Claims, 10 Drawing Figures

SYSTEM FOR INFLATING PACKERS AND PLACING GROUT THROUGH ONE LINE

This invention relates to a system for inflating packers installed in offshore platforms and grouting the annulus between the pile and pile sleeve by utilizing a single line for inflating a plurality of packer and grouting the annulus between the pile and pile sleeves.

As offshore platforms are required to be designed for use in greater depths of the ocean it has become necessary to install pile sleeves about the jacket legs to provide additional anchoring of the offshore platform to the ocean floor. To seal the annulus between the pile, which has been driven to the desired depth in the ocean floor, and the pile sleeve for grouting two inflatable packers are installed in each pile sleeve, one packer being located at the top of the pile sleeve while the other packer is located adjacent the bottom of the pile sleeve, or occasionally only one inflatable packer may be installed in the pile sleeve at the top thereof.

In the past, a separate inflation line has been used for each packer of the packers installed in each pile sleeve and a separate grout injection line has been used for injecting grouting into the annulus between the pile and the pile sleeve as well as a separate grout return line being used for returning excess grouting material to the top of the offshore platform from each pile sleeve. For example, an offshore platform having sixteen pile sleeves would have thirty-two packers installed in the pile sleeves to seal the annuli between the piles and pile sleeves thereby requiring thirty-two packer inflation lines, sixteen grout injection lines and sixteen grout return lines, all of which must run to the top of the platform.

In contrast to the prior art, the present invention reduces the number of packer inflation lines and grout injection lines which must be run to the top of the offshore platform by utilizing a single line running from the top of the platform and a control valve system which has various pressure valves preset to open at differing pressure levels to inflate the various packers and inject grout into the annulus between the pile and pile sleeve as well as one or more sleeve valves to facilitate the inflation and grouting of one or more pile sleeves.

Figure 1:
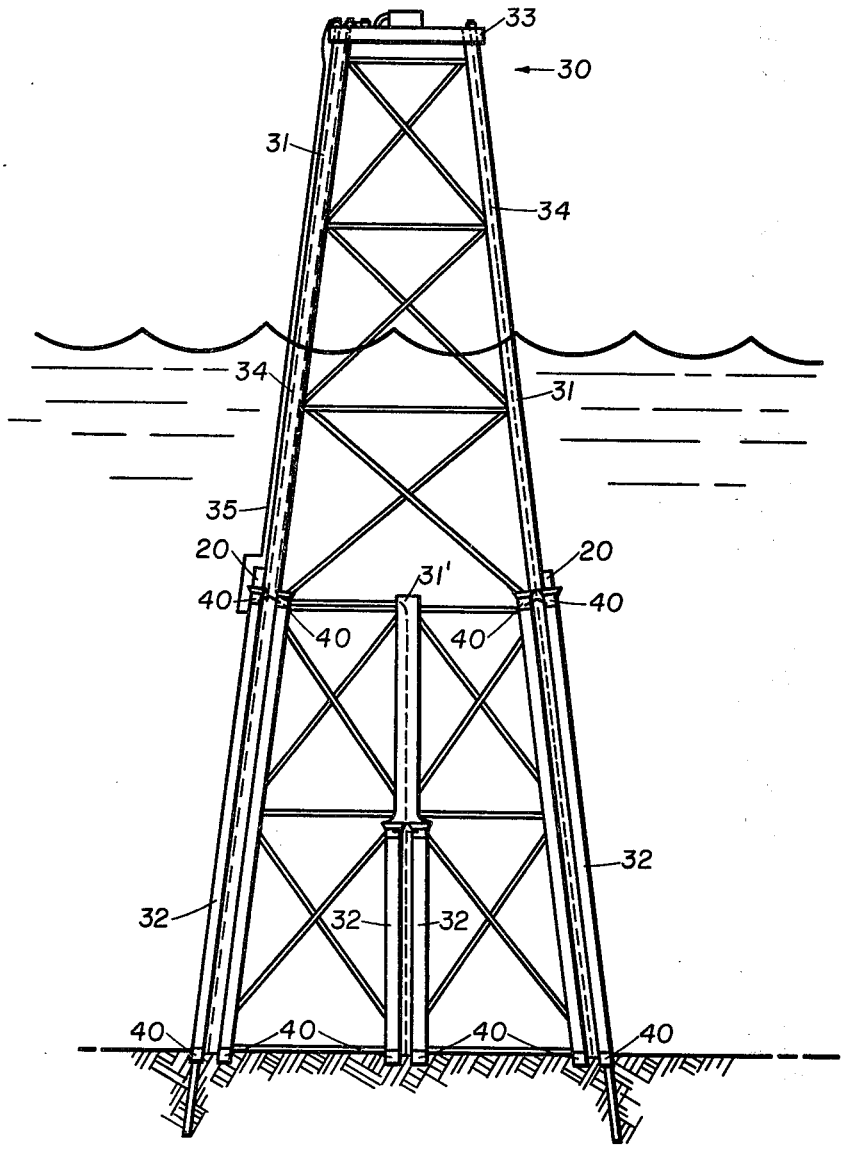
FIG. 1 is an elevational view of the invention installed on an offshore platform with only one grout return line being shown running to the top of the platform for clarity.

Referring to FIG. 1, an offshore platform 30 is shown having a top 33, legs 31 and intermediate legs 31'. The legs 31 and intermediate legs 31' have pile sleeves 32 located thereon with each pile sleeve 32 having an upper packer 40 and lower packer 40 which sealingly engage a pile 20 driven through the pile sleeve 32. As shown in FIG. 1, only two piles 20 have been installed in the pile sleeves 32. As further shown in FIG. 1, the packers 40 are connected by means of inflation lines 34 which run from the packers 40 to the top 33 of the offshore platform 30 where they terminate in any suitable fitting. A grout return line 35 runs from below the upper packer 40 in a pile sleeve 32 to the top 33 of the platform 30. Although a grout return line 35 would be installed in each pile sleeve 32, only one grout return line 35 has been shown for clarity.

Figure 2:
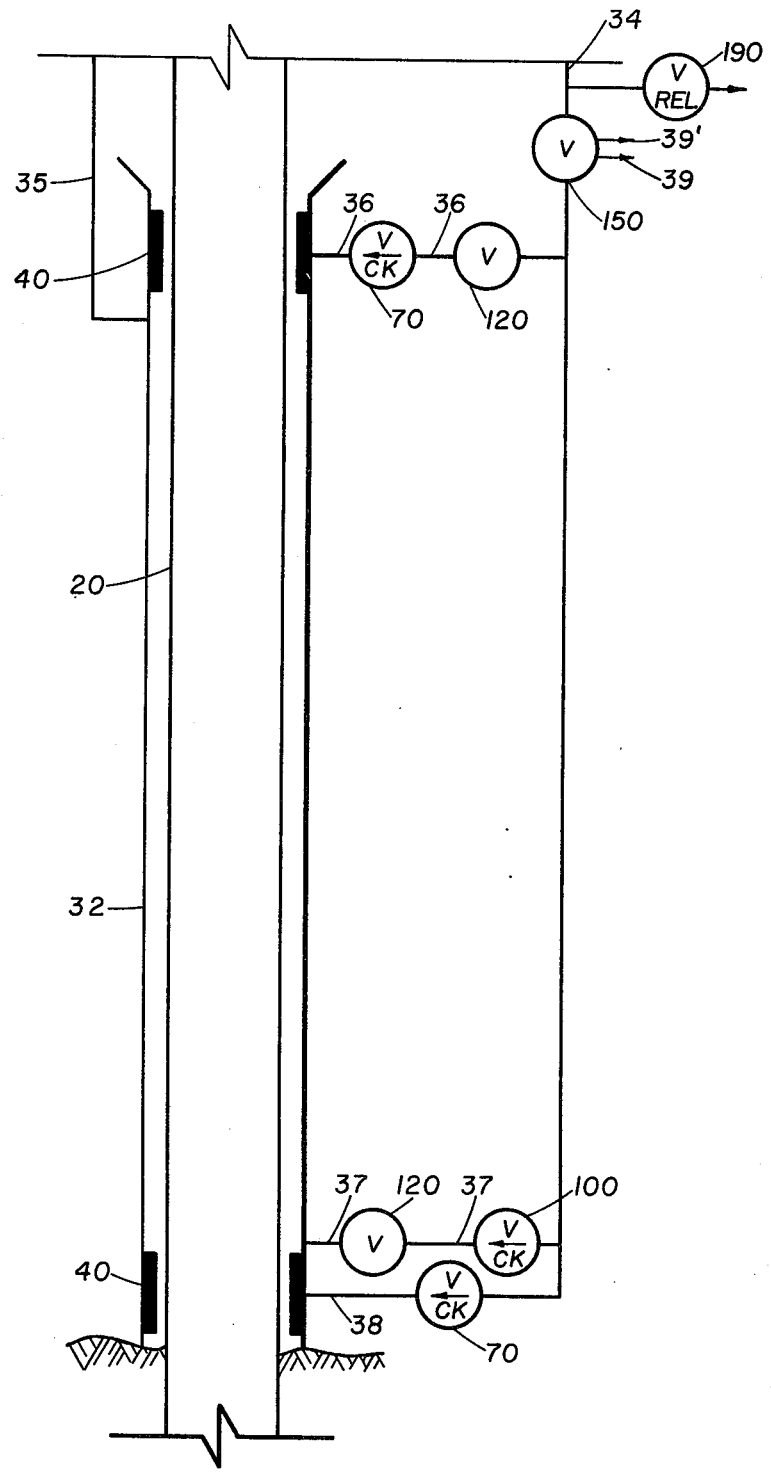
FIG. 2 is a schematic diagram of the control valve system for inflating the various packers and grouting the annuli between the piles and pile sleeves before packer inflation.

Shown in FIG. 2 is the typical schematic diagram for the packer inflation control valve system. A pile sleeve 32 is shown having a pile 20 driven therethrough and further having an inflatable packer 40 located at the upper and lower end thereof. The packers 40 are inflated by means of a single line 34 which when connected in the control valve system also serves as a line through which grouting may be pumped to fill the annulus between the pile 20 and pile sleeve 32.

The control valve system comprises a pressure relief valve 190, a sleeve valve 150, an upper packer inflation check valve 70, an upper packer inflation control valve 120, a lower packer inflation check valve 70, a grout check valve 100 and a grout control valve 120. Although shown in line 34 as being the first valve in the control valve system, the pressure relief valve 150 may actually be located anywhere in the control valve system before the control valves 120 since the only function of the pressure relief valve 150 is to prevent over-inflating the packers 40 thereby preventing the collapsing or buckling of the pile 20 contained within the pile sleeve 32. Installed in branch line 36 leading from line 34 to the upper packer 40 are an upper packer inflation control valve 120 and an upper packer inflation check valve 70. Installed in branch line 37 leading from line 34 to the grout port in the pile sleeve 32 are the grout check valve 100 and a grout control valve 120 while a lower packer inflation check valve 70 is installed in the branch line 38 leading from line 34 to the lower packer 40 installed in pile sleeve 32.

Figure 5:
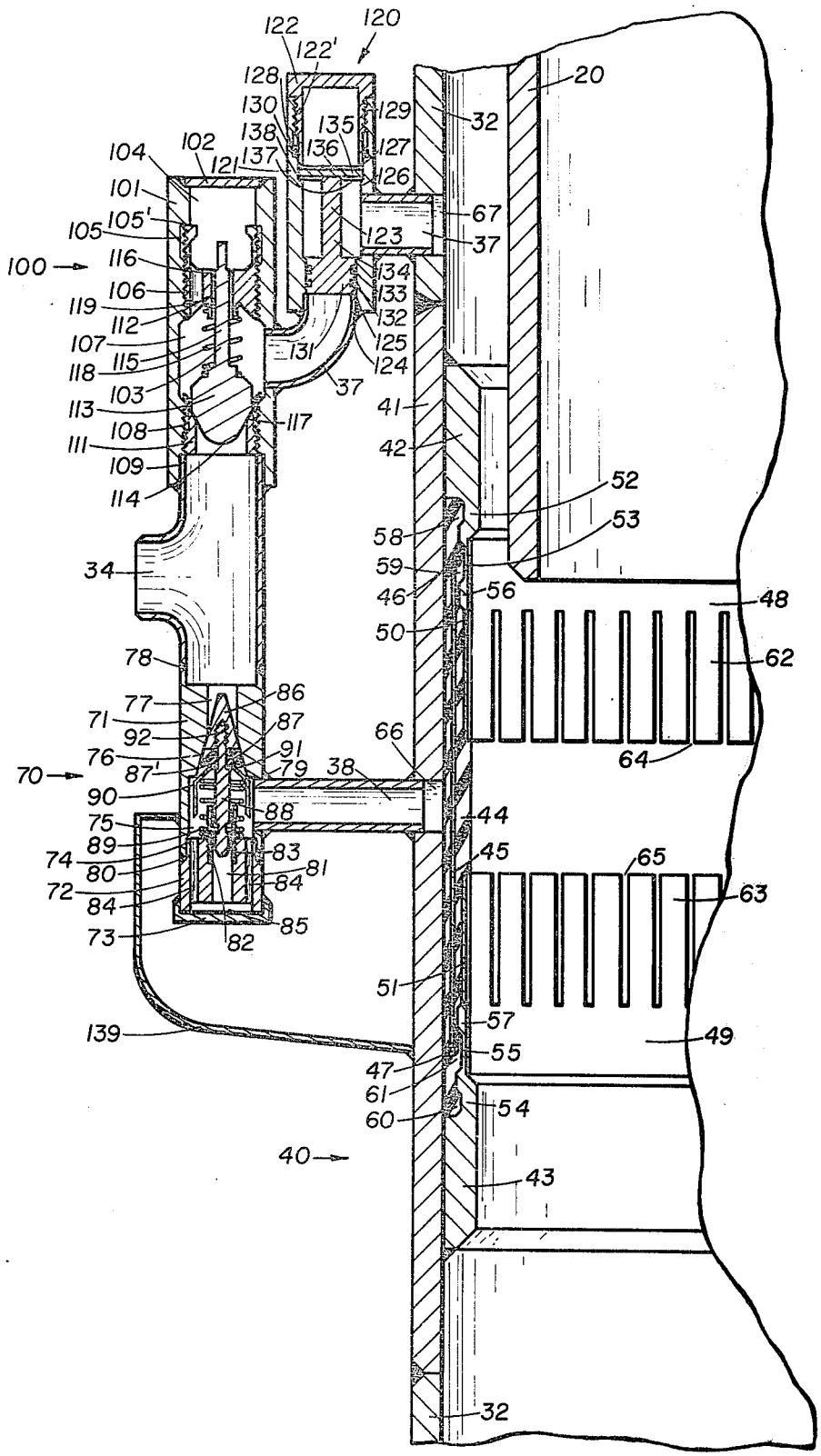
FIG. 5 is a partial sectional view of the lower packer in the pile sleeve in its uninflated position and its associated lower packer inflation check valve, grout check valve and grout control valve.

Referring to FIG. 5, the lower inflatable packer 40 and its associated grout check valve 100, grout control valve 120 and inflation check valve 70 are shown in their preferred embodiment with the inflatable packer 40 uninflated and the pile 20 protruding into the inflatable packer 40.

As shown in FIG. 5, the inflatable packer 40, shown in its preferred embodiment, comprises a packer housing 41, guide rings 42 and 43, an elastomeric packer member 44 and packer member back-up shoes 48 and 49. The packer housing 41 is cylindrical and made in any convenient diameter to match the jacket leg 11 to which it is welded as at 12 and 13.

The guide ring 42 is welded to the packer housing 41 to secure one end of the packer member 44 within the packer housing 41 from any axial movement within the packer housing 41. The guide ring 42 is formed with a reduced thickness portion having two annular channels 52 and 53 which mate with the annular beads 58 and 59 respectively on one end of the packer member 44. The guide ring 42 further includes annular bead 56 which prevents the withdrawal of annular bead 59 of packer member 44 from annular channel 53.

Similarly, guide ring 43 is welded to the packer housing 41 to secure the other end of the packer member 44 within the packer housing 41 from any axial movement within the packer housing 41. The guide ring 43 is formed with a reduced thickness portion having two annular channels 54 and 55 which mate with annular beads 60 and 61 respectively on the other end of packer member 44. The guide ring 43 further includes annular bead 57 which prevents the withdrawal of annular bead 61 of packer member 44 from annular channel 55.

The packer member 44 can be formed of any suitable elastomeric material, although rubber is preferred. The packer member 44 has an annular reinforcing member 45 which is anchored about one end by an annular metal ring 46 contained in annular bead 59 located on one end of the packer member 44 while the other end of reinforcing member 45 is anchored about annular metal ring 47 contained in annular bead 61 located on the other end of the packer member 44. The reinforcing member 45 can be of any suitable material, although a fabric of nylon or Kevlar is peferred. The annular metal rings 46 and 47 may be either solid steel or twisted steel cable. The packer member 44 further comprises an annular band of material 50 located adjacent one end of the packer member 44 on the inner diameter thereof which underlies the fingers 62 of back-up shoe 48 while an annular band of material 51 located adjacent the other end of the packer member 44 on the inner diameter thereof underlies the fingers 63 of back-up shoe 49. The annular bands 50 and 51 of the material serve to protect the packer member 44 from damage by the fingers 62 and 63 of the back-up shoes 48 and 49 respectively when the packer element is being inflated and to prevent the flow of rubber into the slots 64 and 65 when the packer member 44 is being formed. The annular bands 50 and 51 may be formed of any suitable flexible material which has sufficient strength to protect packer member 44, such as steel, brass, etc., although a fabric of nylon or Kevlar is preferred.

The back-up shoe 48 is an annular metal band having fingers 62 separated by spaces 64 and is located on the inner diameter of the packer member 44 adjacent one end thereof. Similarly, the back-up shoe 49 is an annular metal band having fingers 63 separated by spaces 65 and is located on the inner diameter of the packer member 44 adjacent the other end thereof. The back-up shoes 48 and 49 may be formed of any suitable metal, although steel is preferred. The back-up shoes 48 and 49 initially protect the packer element 44 from being damaged by the pile 20 while the pile is being driven therethrough since the back-up shoes 48 and 49 hold the packer member 44 against the packer housing 41 until the packer member 44 is inflated.

As further shown in FIG. 5, the lower packer inflation check valve 70 is connected to the inlet port 66 of the packer 40 by means of branch line 38. The lower packer inflation check valve 70 comprises a housing, a valve body and a valve body return spring.

The check valve housing comprises a first member 71 which engages the plug portion of the valve body, a second member 72 which engages the stem portion of the valve body and an end cap 73. The first member 71 is formed with a bore 74 to accept a portion of the second member 72, a bore 75 which communicates with branch line 38, a conical bore 76 which engages the plug portion of the valve body and a bore 77 which communicates with inflation line 34. The first member is connected to the inflation line 34 at 78 by means of welding. Similarly, the first member 71 is connected to branch line 38 at 79 by means of welding. Although the first member has been shown connected to inflation line 34 and branch line 38 by means of welding, any suitable type fastening means may be used.

The second member 72 is welded to the first member 71 at 80 thereby securing the members together. The second member 72 comprises a central bore 81 having a valve body guide 82 threadedly engaging the second member 72 at 83 and a plurality of bores 84 which provide communication between the cavity formed by bore 75 in the first member 71 and the cavity formed by bore 85 in the second member 72. The end of the second member 72 is sealed by a cap 73 secured thereto by any convenient means such as welding.

The valve body contained within the housing formed by the first member 71, second member 72 and end cap 73 comprises a valve body cap 86, resilient valve body seal 87, valve body stem 88, valve body spring 89 and valve body spring cup 90. The valve body stem 88 is formed with one end having the resilient valve body seal 87 being held in position against annular shoulder 91 by the valve body cap 86 threadedly engaging the end 92 of the valve body stem 88. The valve body spring cup 90 abuts the lower surface 87′ of the resilient valve body seal 87 and, in turn, acts as a retaining means for the upper end of the valve body spring 89 which is centered about valve body stem 88 and valve body guide 82. Although the valve body cap 86 has been shown as being threadedly secured to the valve body stem 88, any suitable fastening means may be used. Additionally, the resilient valve body seal 87 may be formed of any suitable elastomeric material.

As shown, the resilient valve body seal 87 and valve body cap 86 are biased into engagement with the conical bore 76 of the first member 71 of the check valve housing by means of the valve body spring 89.

Additionally shown in FIG. 5, connected to line 34 are the lower packer grout check valve 100 and grout control valve 120 which are, in turn, connected via branch line 37 to the grout port 67 in the pile sleeve 32.

The lower packer grout check valve 100 comprises a grout check valve housing 101, grout check valve cap 102 and grout check valve plug body 103.

The grout check valve housing 101 is formed with a bore 109 which receives a portion of line 34, threaded bore 108 which receives plug body head insert 111, bore 107 which communicates with branch line 37, threaded bore 106 which receives a portion of plug body stem insert 112, bore 105 which receives a portion of plug body stem insert 112, and bore 104 which is closed on one end by means of grout check valve cap 102.

The line 34, grout check valve cap 102 and branch line 37 are secured to the grout check valve housing 101 by any suitable means, such as welding.

The grout check valve plug body 103 is formed with a plug body head 113 having a protective covering 114 thereon and a plug body stem 115 which slides in aperture 116 of plug body stem insert 112. The plug body head 113 sealingly engages conical surface 117 of plug body head insert 111 which is threaded into the grout check valve housing 101, or secured by any other suitable means. The protective covering 114 on plug body head may be of any suitable elastomeric material, although rubber is preferred.

The plug body head 113 is biased into engagement with the conical surface 117 of plug body insert 111 by means of spring 118 which is centered about the plug body stem 115 and has one end abutting the plug body head 113 with the other end abutting the plug body stem insert 112.

The plug body stem insert 112 is threadedly engaged in grout check valve housing 101 and is formed with a central aperature 116 through which plug body stem 115 extends as well as one or more aperatures 119 which provide fluid communication between bores 107 and 104 of the grout check valve housing 101. When installed in the grout check valve housing 101, the plug body stem insert 112 may abut shoulder 105' of the bore 105 in the grout check valve housing 101.

As shown in FIG. 5, a grout control valve 120 is installed in the branch line 37 between the grout check valve 100 and the grout inlet port 67 in the pile sleeve 32. The grout control valve 120 comprises a grout control valve housing 121, a grout control valve cap 122 and grout control valve body 123.

The grout control valve housing 121 is formed with a bore 124 which communicates with branch line 37, bore 125 which receives head 131 of the grout control valve body 123, bore 126 which communicates with branch line 37, bore 127 which receives the shear pin 135 of grout control valve body 123, annular body groove 128 which receives annular seal means 130, and threaded bore 129 which threadedly engages the threaded portion 122' of the grout control valve cap 122. To form a fluid tight seal between the grout control valve cap 122 and the grout control valve housing 121 an annular seal means 130 is disposed in annular groove 128. The annular seal means 130 may be of any suitable material, although an elastomeric O-ring is the preferred seal means. The branch line 37 may be secured to the grout control valve housing 121 by any suitable means, although welding is preferred.

The grout control valve plug body 123 comprises a head portion 131 having annular grooves 132 containing annular seal means 133 which sealingly engage bore 125 of the grout control valve housing 121, a stem portion 134 and a shear pin 135 installed in an aperature 136 in the end of stem portion 134. The shear pin 135 is held in position in the grout control valve housing 121 by means of a washer 137 which is, in turn, held in position by the grout control valve cap 122 forcing the washer in abutment with shoulder 138 in the grout control valve housing 121. The washer 137 has a central aperature of sufficient size to allow the stem portion 134 of the grout control valve plug body 120 to freely slide therethrough upon shearing of the shear pin 135.

As further shown in FIG. 5, a valve guard 139 is provided to protect the lower packer inflation check valve 70, the grout check valve 90 and grout control valve 120 from damage during platform handling operations.

Figure 6:
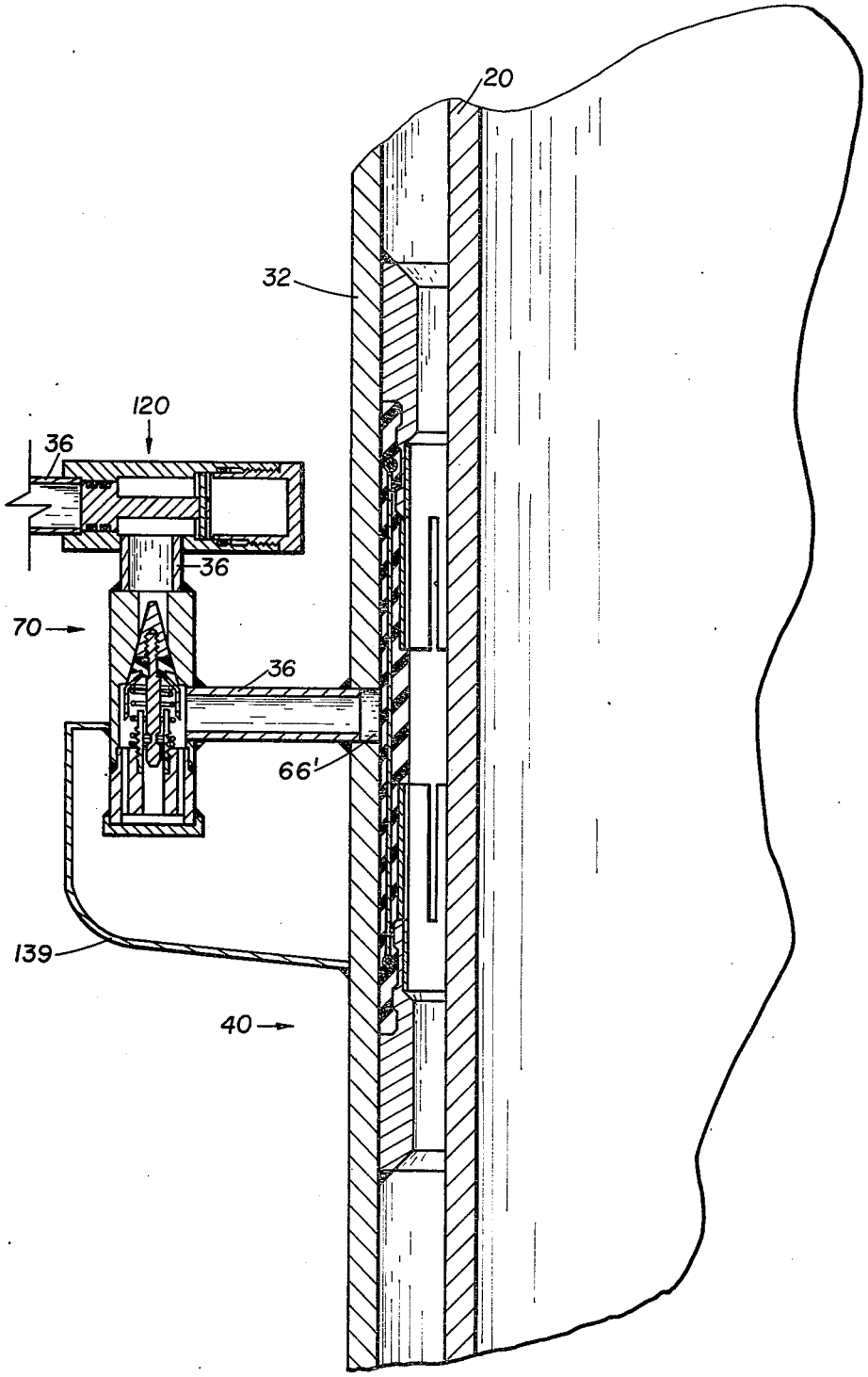
FIG. 6 is a partial sectional view of the upper packer in the pile sleeve in its uninflated position and its associated packer inflation check valve and packer inflation control valve.

Referring to FIG. 6, the upper packer 40 and its associated upper packer inflation check valve 70 and upper packer inflation control valve 120 are shown. The upper packer inflation check valve 70 and upper packer inflation control valve 120 are installed in the branch line 36 between line 34 and the upper packer inflation port 66'. A valve guard 139 is provided to protect the upper packer inflation check valve 70 and upper packer inflation control valve 120 from damage during platform handling operations.

As shown in FIG. 6, the construction of the upper packer inflation check valve 70 and the upper packer control valve 120 are identical to the construction of the lower packer inflation check valve 70 and grout control valve 120 illustrated in FIG. 5. The control valve 120 may be used to control either the packer inflation pressure or the initial grout injection pressure. In this connection, the upper packer 40 is identical in construction to the lower packer 40 described and illustrated in FIG. 5.

Not shown in FIG. 6 is the grout return line 35 which is installed in the pile sleeve 32 immediately below the packer 40.

Figure 7:
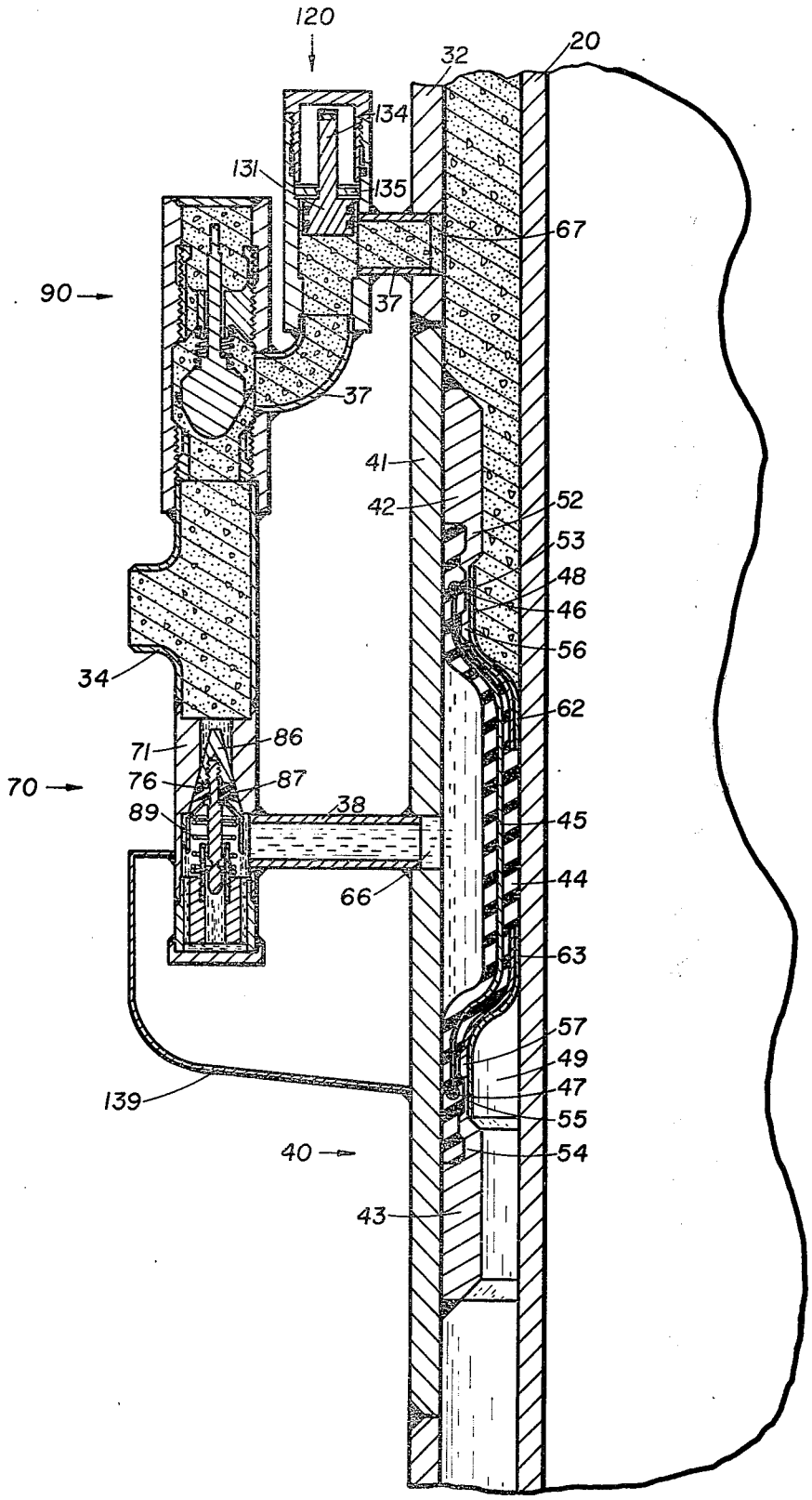
FIG. 7 is a partial sectional view of the lower packer in the pile sleeve in its inflated position and its associated lower packer inflation check valve, grout check valve and grout control valve with grout being injected into the annulus between the pile and pile sleeve.

Referring to FIG. 7, the lower packer 40 is shown inflated and grout being injected into the annulus between the pile 20 and pile sleeve 32.

The packer member 44 is inflated to firmly grip the pile 20, which has been driven to the desired depth, by pumping any suitable fluid or gas, usually water, under pressure through the packer inflation port 66. As shown, when the packer member 44 is inflated, the back-up shoes 48 and 49 are deflected inwardly until the fingers 62 and 63 are seated on the pile 20. When the packer member 44 is in its inflated position, the back-up shoes 48 and 49 lend axial support to the packer member 44 and prevent axial extrusion and subsequent damage of the packer member 44 over annular beads 56 and 57 of guide rings 42 and 43 respectively. As further shown, when the packer member 44 is inflated, the ends of the packer member 44 are secured from axial movement by means of annular rings 46 and 47. The annular metal rings 46 and 47 prevent the ends of packer member 44 from being forced from the annular channels 52 and 53 of the guide ring 42 and annular channels 54 and 55 of guide ring 43 respectively since the annular metal rings 46 and 47 prevent the compression of the ends of the packer member 44 to a degree which would allow the ends of the packer member 44 to pass between the annular beads 56 and 57 and the packer housing 41.

The ends of the packer member 44 may be secured against axial movement within the packer housing 41 by the guide rings 42 and 43 since the inflation of the packer member 44 occurs inwardly thereby effectively compressing the packer member 44.

After the packer member 44 has been inflated, grouting material is pumped through the grouting port 67 into the annulus between the pile 20 and the platform jacket leg 11 above the packer 40 with the packer supporting the weight of the grouting in the annulus while preventing the grouting from leaking into the annulus below the packer 40 or the surrounding environment from leaking into the annulus above the packer 40 and contaminating the grouting material.

When the lower packer 40 is inflated, the inflation fluid, usually water, is trapped by the lower packer inflation check valve 70. To fill the annulus between the pile 20 and pile sleeve 32 with grout, after inflating the lower packer 40, grout is pumped through line 34 under sufficient pressure to shear the portion of shear pin 135 contained within aperature 136 in the end of the stem portion 134. When the grout control valve plug body 123 is free to move in the grout control valve housing 121, the grout control plug body head 131 is forced out of sealing engagement with bore 125 in the grout control valve housing 121 whereby allowing grout to flow through branch line 37 connecting the grout control valve 120 to the grout port 67 in the pile sleeve 32 and into the annulus between the pile 20 and pile sleeve 32.

Once the shear pin 135 is sheared and the grout control valve body head 131 no longer sealingly engages bore 125 in the grout control valve housing 121 thereby allowing grout to flow therethrough, the grout injection pressure drops dramatically causing a pressure differential to occur across the lower packer inflation check valve 70 holding the check valve in the closed position due to the lower packer inflation check valve trapping the packer inflation fluid or preventing the flow thereof in the annulus formed between the packer housing 41 and packer member 44 on one side of the lower packer inflation check valve 70 while the other side of the check valve is merely exposed to grout injection pressure.

Figure 8:
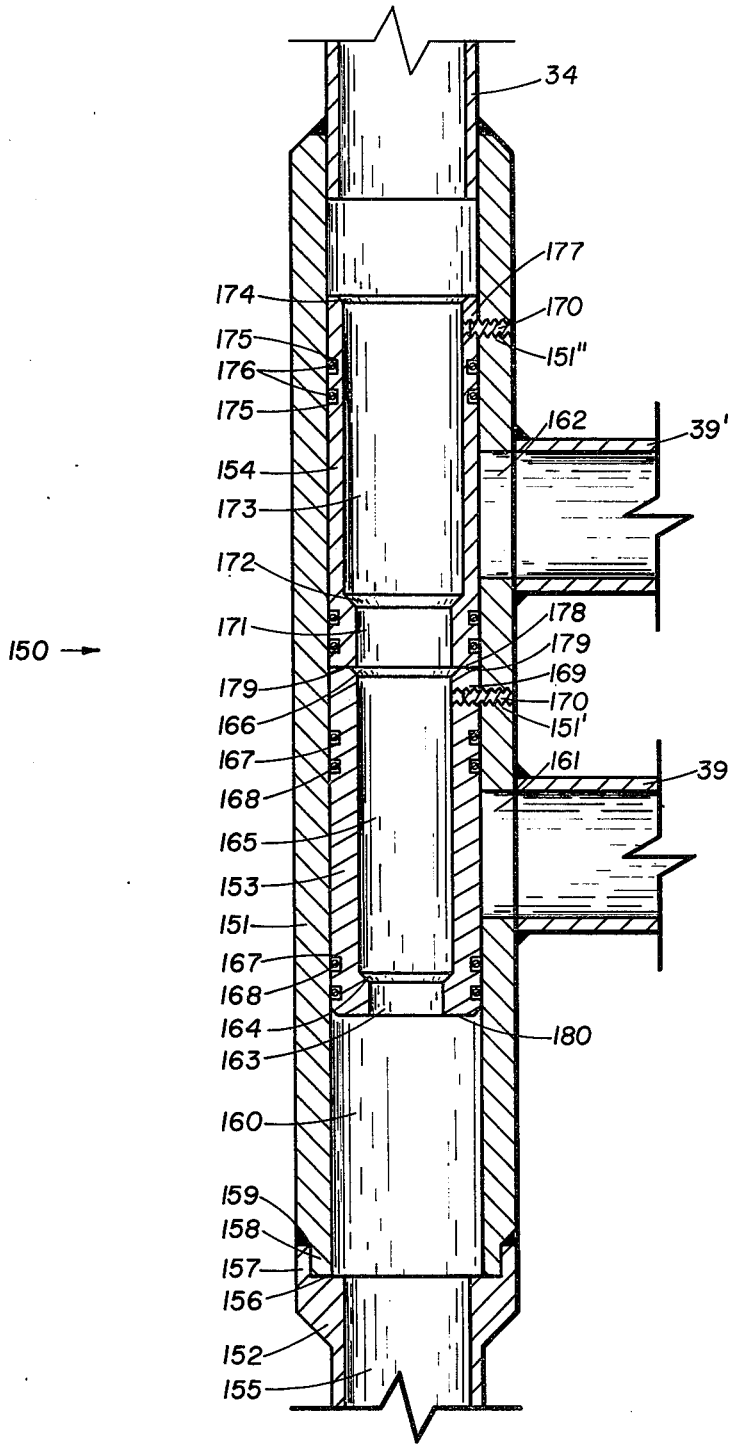
FIG. 8 is a sectional view of the sleeve valve used to control the flow of inflation fluid and flow of grout to the various pile sleeves.

Referring to FIG. 8, the sleeve valve 150 is shown in its preferred embodiment. The sleeve valve 150 comprises a housing, first sliding sleeve 153 and a second sliding sleeve 154.

The sleeve valve housing comprising a first member 151 containing the first sliding sleeve 153 and second sliding sleeve 154 and a second member 152 which serves as a stop for the first sliding sleeve 153. The first member 151 is secured to the line 34 by an convenient means, although welding is preferred. The second member 152 is secured to the first member 151 and the line 34 (not shown) by any suitable means, although welding is preferred.

As shown, the second member 152 is formed with a bore 155 which communicates with line 34, a shoulder 156 which serves as an abutment for first member 151 and first sleeve 153, and bore 157 which acts as a pilot when receiving the end of the first member 151. The first member 151 is formed with a reduced thickness portion 158 which is retained in the bore 157 of second member 152, a chamber 159 which facilitates welding of the first member 151 to the second member 152 and a bore 160 in which, the first sleeve 153 and second sleeve 154 slide, a first port 161 associated with the first sleeve 153 and a second port 162 associated with the second sleeve 154. The first port 161 communicates with line 39 while the second port communicates with line 39'. The lines 39 and 39' may be secured to the first member 151 of the housing by any suitable means, although welding is preferred. Although not illustrated, line 39 and line 39' may each lead to another pile sleeve having the upper and lower packer and associated control valves as illustrated schematically in FIG. 2 and in detail in FIGS. 3 and 4. Also located in the side wall of the first member 151 between the first ports 161 and second port 162, is a threaded bore 151' which receives a shear pin 170 while threaded bore 151" is located in the side wall of the first member 151 above port 162 and also receives a shear pin 170.

The first sleeve 153 is formed with a bore 163, a lower chamfer 164, a bore 165, an upper chamfer 166, a plurality of annular grooves 167 each containing an elastomeric sealing means such as an elastomeric O-ring and a threaded bore 169 located in the sidewall of the first sleeve 153.

The first sleeve 153 is held in position in the first member 151 of the sleeve valve housing by means of a shear pin 170 threadedly engaging threaded bore 151' in the first member 151 and threaded bore 169 in the first sleeve 153. When held in position within the first member 151 of the sleeve valve housing, the first sleeve 153 blocks the first port 161 to prevent the flow of fluid therethrough.

The second sleeve 154 is formed with a bore 171 which is the same diameter as bore 165 of the first sleeve 153, a lower chamfer 172, a bore 173, an upper chamfer 174, a plurality of annular grooves 175 each having an elastomeric seal means 176 such as an elastomeric O-ring contained therein, and a threaded bore 177 located in the sidewall of the second sleeve 154. The second sleeve 154 is held in position in the first member 151 of the sleeve valve housing with the lower surface 178 of the second sleeve 154 abutting the upper surface 179 of the first sleeve by means of a shear pin 170 threadedly engaging threaded bore 151" in the first member 151 and threaded bore 177 in the second sleeve 154. When held in position within the first member 151 of the sleeve valve housing, the second sleeve blocks the second port 162 to prevent the flow of fluid therethrough.

Figure 9:
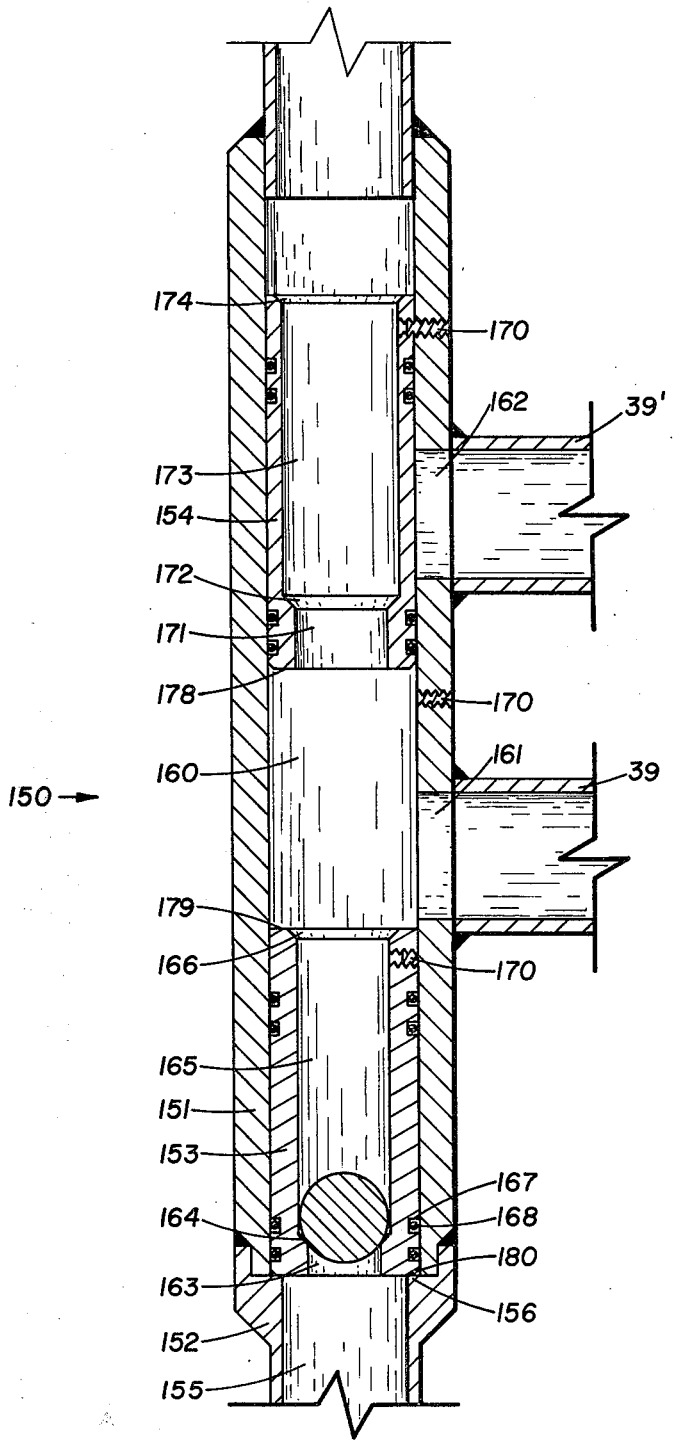
FIG. 9 is a sectional view of the sleeve valve used to control the flow of inflation fluid and flow of grout to the various pile sleeves having one of the ports open to communicate with a branch line leading to another pile sleeve.

Referring to FIG. 9, to open port 161 to fluid flow a ball, which is slightly smaller than bore 165 in the first sleeve 153, is inserted in line 34 and pumped or allowed to free fall therethrough until it seats on chamfer 164 located intermediate bores 163 and 165 of the first sleeve 153. When the ball has seated on chamfer 164, the pressure in line 34 is increased until the shear pin 170 is sheared thereby freeing the first sleeve 153 to move downwardly in the first member 151 of the sleeve valve housing until the lower surface 180 of the first sleeve 153 abuts shoulder 156 of the second member 152 of the sleeve valve housing. When the first sleeve 153 has surface 180 abutting shoulder 156 of the second member 152 of the sleeve valve housing, flow through the first sleeve 153 is stopped by the ball sealingly engaging chamfer 164. Any subsequent flow is directed through open port 161 and through branch line 39.

Although not illustrated, to open the port 162 communicating with branch line 39' to fluid flow a ball slightly smaller than bore 154 of the second sleeve 154 is inserted in line 34 and pumped or allowed to free fall therethrough until it seats on chamfer 172, located intermediate bores 171 and 173 of the second sleeve 154. When the ball has seated on chamfer 172, the pressure in line 34 is increased until the shear pin 170 is sheared thereby freeing the second sleeve 154 to move downwardly in the first member 151 of the sleeve valve housing until the lower surface 178 abuts the upper surface 179 of the first sleeve 153, at which time the port 162 in the first member 151 of the sleeve valve housing is uncovered and port 161 is sealed by the second sleeve 154.

When the second sleeve 154 has surface 178 abutting upper surface 179 of the first sleeve, flow through the second sleeve 154 is stopped by the ball sealingly engaging chamfer 171. Any subsequent flow is directed through open port 162 and through branch line 39'.

Although the sleeve valve has been illustrated having only two sliding sleeves and two outlet port, the sleeve valve could be formed with any number of sleeves and outlet ports. Additionally, although a sleeve valve means is preferred, any commercially available valve means which can be actuated through the single inflation line to grout a plurality of pile sleeves may be used either singly or in series in the control valve system.

Figure 10:
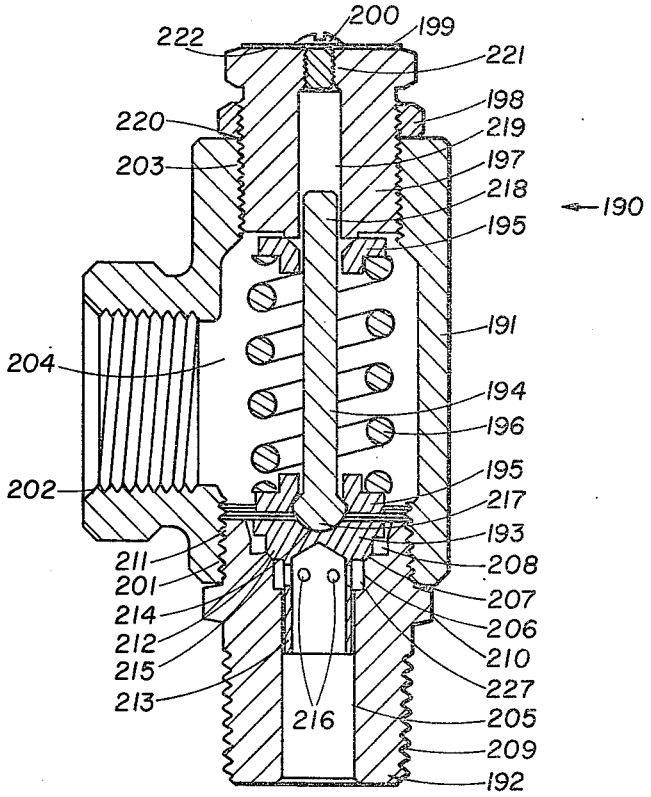
FIG. 10 is a sectional view of the pressure relief valve used to control the inflation fluid pressure and grouting material pressure to prevent over-inflation of the packers which would result in the collapsing of the pile.

Referring to FIG. 10, the pressure relief valve 190 is shown in its preferred embodiment. The pressure relief valve 190 comprises a valve cylinder 191, base 192, valve disc 193, valve spindle 194, valve spring washers 195, valve spring 196, valve spring adjusting bolt 197, valve spring adjusting bolt lock nut 198, washer 199 and screw 200.

The valve cylinder 191 is formed having threaded bores 201, 202, and 203 therein for receiving base 192, an outlet line (not shown) and adjusting bolt 197 respectively. The valve cylinder 191 is further formed with a central cavity 204 to receive valve spindle 194, valve spring washers 195 and valve spring 196 therein.

The base 192 is formed having a bore 205 which receives the barrel portion 214 of the valve disc 193, bore 206, chamfer 207 and bore 208. On the exterior of base 192 lower threaded portion 209 is separated by annular rib 210 from upper threaded portion 211 which engages threaded bore 201 of the valve cylinder 191. Although not shown, lower threaded portion 209 engages a threaded fitting in line 34 which serves as a connection point for the pressure relief valve 190.

The valve disc 193 is formed having a disc portion 212 and barrel portion 213. The disc portion 212 is formed with a central recess 214 in the top surface thereof and a chamfer 215 which sealingly engages chamfer 207 of the base 192. The barrel portion 213 of the valve disc 193 is formed with a plurality of openings 216 which communicate with cavity 217 formed by bore 206 of the base 192 and the exterior surface of the valve disc barrel portion 213. When the valve disc chamfer 215 disengages chamfer 207 of the base 192 fluid is free to flow through bore 205 of the base 192, through holes 216 in the valve disc barrel portion 213, through cavity 227 into cavity 204 in the valve cylinder 191 and through bore 202 into a discharge line (not shown).

To bias the valve disc 193 closed, a valve spring 196 is used to bear upon valve spring washers 195 which, in turn, bear upon the enlarged head 217 of the valve spindle 194 and valve spring adjusting bolt 197. The enlarged head 217 of the valve spindle 194 engages the central recess 214 in the valve disc portion 212 of the valve disc 193 while the upper end 218 of the valve spindle 194 is free to move in bore 219 of valve spring adjusting bolt 197.

The tension on valve spring 196 may be increased by threadedly advancing valve spring adjusting bolt 197 in threaded bore 203 of the valve cylinder 191. When the desired valve spring 196 tension has been achieved, the locking nut 198 is advanced to bear against the top surface 220 of the valve cylinder 191. To seal the bore 219 in the valve spring adjusting bolt 197, a threaded member 200 is threaded into the threaded portion 221 of the bore 219 until the washer 199 sealingly engages the upper surface 222 of the valve spring adjusting bolt 197.

The pressure relief valve 190 described hereinbefore is a typical commercially available pressure relief valve which is suitable for use in the line 34. Any type commercially available pressure relief valve may be used in line 34 in place of relief valve 190 described hereinbefore.

Figure 3:
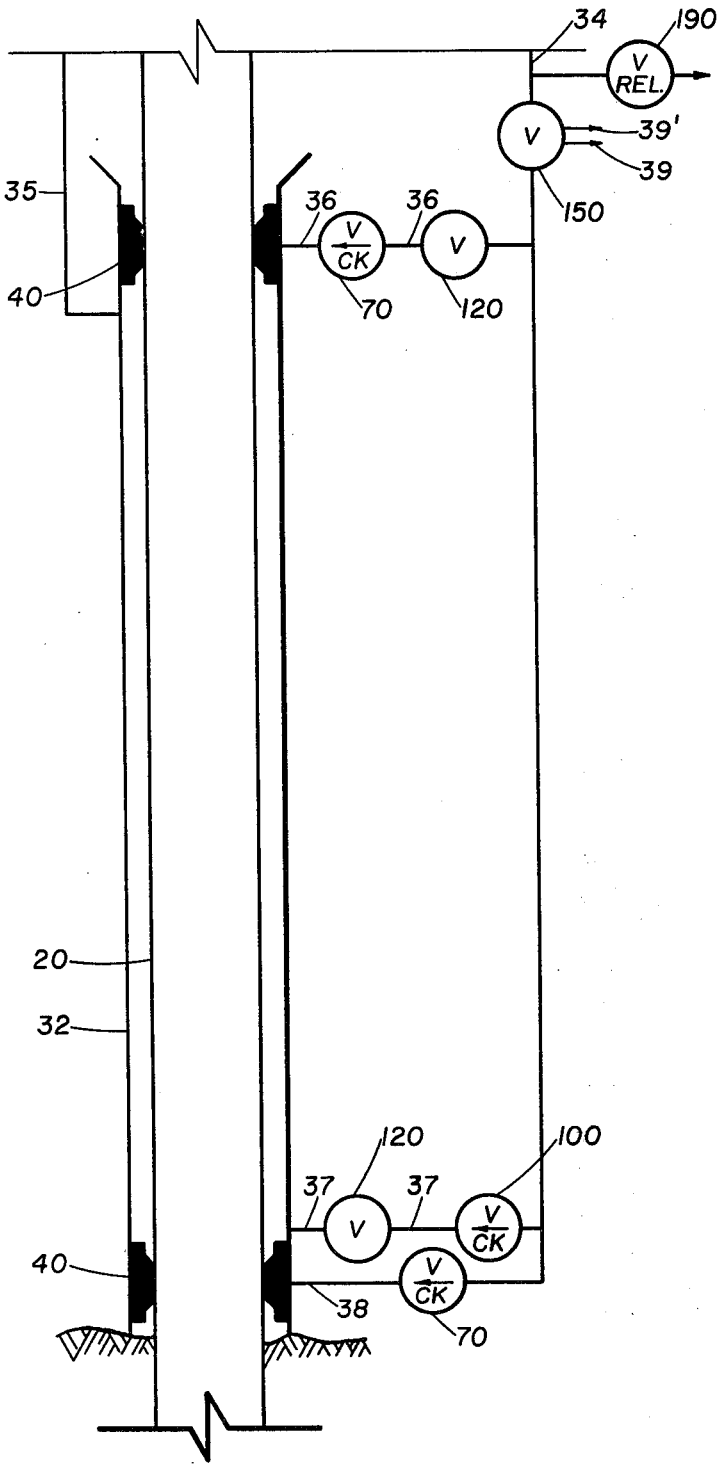
FIG. 3 is a schematic diagram of the control valve system for inflating the various packers and grouting the annuli between the piles and pile sleeves after packer inflation but before grout injection into the annulus between the pile and pile sleeve.

Referring to FIG. 3, the inflation procedure for the upper and lower packers 40 will be set forth. In a typical grouting operation of a pile sleeve 32 the opening pressures of the lower packer grout control valve 120 and the upper packer inflation control valve 120 must be selected. A typical lower packer grout control valve 120 opening pressure is 400 psi (pounds per square inch) while the corresponding upper packer inflation control system valve 120 opening pressure is 300 psi. To vary the opening pressure of either the lower packer grout control valve 120 or upper packer inflation control valve 120 it is only necessary to change the size of the shear pin 135 with a larger diameter shear pin giving a higher opening pressure for the control valve 120. While the opening pressure of 300 psi has been selected for the upper packer inflation control valve 120 and an opening pressure of 400 psi has been selected for the lower packer grout control valve 120, the opening pressures could be any desired level.

After a pile 20 has been driven to the desired depth, to inflate the lower packer 40 fluid, usually water, is pumped through line 34 at a pressure less than 300 psi. After pumping a sufficient volume of fluid to inflate the packer 40, the system is closed in and checked for leaks. Any leaks will be indicated as a loss of pressure. If no leaks are found, the upper packer 40 is inflated by raising the fluid pumping pressure above 300 psi but less than 400 psi thereby shearing the shear pin 135 in the upper packer inflation control valve 120 allowing fluid to enter the packer 40 through branch line 36. After the inflation of the upper packer 40, the system is again closed in and checked for leaks. If there are no leaks, the fluid pressure is increased above 400 psi thereby shearing the shear pin 135 in the grout control valve 120. When the grout control valve 120 opens, the pressure in the line 34 will drop indicating the annulus between the pile sleeve 32 and the pile 20 is ready to receive the grout. At this time the pressure in the line 34 is released with the upper and lower packers 40 remaining inflated and sealingly engaging the pile 20 since the upper and lower packer check valves 70 prevent the fluid from the packers 40 flowing into the line 34. After the packers 40 have been inflated but before grout has been pumped into the annulus formed between the pile 20 and pile sleeve 32, the annulus formed between the pile 20 and pile sleeve 32 can be cleared of any water and checked for leaks, although not necessary, by injecting air or any suitable gas into the annulus through line 34 and branch line 37 with the water flowing out the grout return line 35 to the surface 33 of the offshore platform 30.

Figure 4:
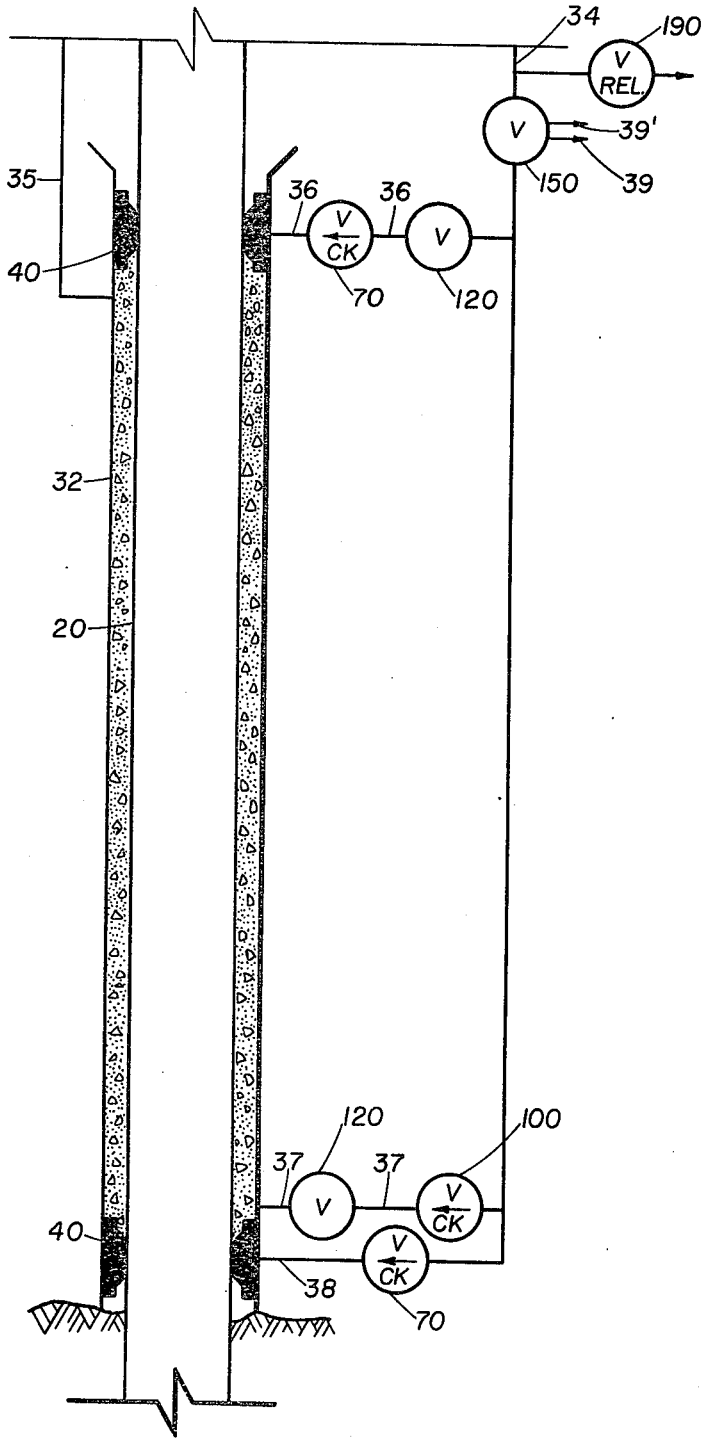
FIG. 4 is a schematic diagram of the control valve system for inflating the various packers and grouting the annuli between the piles and pile sleeves after packer inflation and grout injection into the annulus between the pile and pile sleeve.

Referring to FIG. 4, the annulus between the pile 20 and pile sleeve 32 is shown with the grout filling the annulus. To fill the annulus between the pile 20 and the pile sleeve 32 with grout, grout is pumped through line 34 and branch line 37 into the annulus until grout flows out the top of the grout return line 35 located at the top 33 of the offshore platform 30. After the annulus between the pile 20 and pile sleeve 32 is full of grout the pressure in line 34 may be released with the grout check valve 100 maintaining the grout in the annulus, thereby preventing the flow of grout into line 34. If desired, the grout check valve 100 may be deleted from the control valve system. However, if the grout check valve 100 is not included in the control valve system it will be necessary to maintain the pressure in line 34 until the grout in the annulus between the pile 20 and pile sleeve 32 hardens.

Before the completion of the pumping of the grout material into the annulus between the pile 20 and pile sleeve 32, a ball having a slightly smaller diameter than bore 165 of sleeve 153 of sleeve valve 150 is placed in the line 34 and pumped or allowed to free fall to the sleeve valve 150 to open port 161 therein when the ball is subjected to fluid pressure to allow the subsequent grouting of another annulus between pile 20 and pile sleeve 32 through branch line 39.

Before the completion of the grouting of the annulus between the other pile 20 and pile sleeve 32, a second ball having a slightly smaller diameter than bore 173 of sleeve 154 of sleeve valve 150 is placed in the line 34 and pumped or allowed to free fall to the sleeve valve 150 to open port 161 therein when the ball is subjected to fluid pressure to allow the grouting of yet another annulus between a pile and pile sleeve 32 through branch line 39'.

The number of pile sleeves 32 which may be grouted using a single line 34 is dependent upon the number of sleeves in the sleeve valve 15 and the number of sleeve valves 150 employed in the grouting control valve system.

Alternatively, after a pile 20 has been driven to the desired depth, the upper packer 40 may be inflated first by selecting a packer inflation control valve having the desired opening pressure and installing the same in branch line 38 connecting the lower packer 40 with line 34 (not illustrated) while deleting the control valve connected with the upper packer. A typical opening pressure for the packer inflation control valve would be 300 psi, if a grout control valve having an opening pressure of 400 psi is used in the control valve system.

To inflate the upper packer 40 fluid, usually water, is pumped through line 34 at a pressure less than 300 psi. After pumping a sufficient volume of fluid to inflate the upper packer 40, the system is closed in and checked for leaks, which will be indicated by a loss of control system pressure. If no leaks are found, the annulus between the pile sleeve 32 and pile 20 is evacuated by injecting air or any suitable gas into the grout return line 35 to force the water in the annuli out the bottom of the pile sleeve 32 past the lower packer 40. Subsequently, the lower packer 40 is inflated by raising the fluid pumping pressure in line 34 above 300 psi but less than 400 psi thereby shearing the shear pin 135 in the lower packer inflation control valve 120 allowing fluid to enter the packer 40 through branch line 38. After the inflation of the lower packer 40, the system is again closed in and checked for leaks. If there are no leaks, the fluid pressure is increased above 400 psi in line 34 thereby shearing the shear pin 135 in the grout control valve 120. When the grout control valve 120 opens, the pressure in the line 34 will drop indicating the annulus between the pile sleeve 32 and the pile 20 is ready to receive the grout. At this time the pressure in the line 34 is released with the upper and lower packers 40 remaining inflated and sealingly engaging the pile 20 since the upper and lower packer check valves 70 prevent the fluid from the packers 40 flowing into the line 34. Subsequently, the air or gas pressure is released in the annulus and the grouting material is injected into the annulus formed between the pile sleeve 32 and pile 20 through line 34 and branch line 37 with the excess grouting material flowing to the surface 33 of the platform 30 via grout return line 35.

Another alternative grouting method of the annulus between the pile sleeve 32 and the pile 20 occurs when the lower packer 40 in the pile sleeve 32 has an inflation control valve 120 installed in the branch line 38 connecting the lower packer 40 with the line 34 while the control valve 120 is deleted from the upper packer 40. After a pile 20 has been driven the desired depth, the upper packer 40 may be inflated first by selecting a lower packer inflation control valve opening pressure of 300 psi, if a grout control valve having an opening pressure of 400 psi is used in the control valve system.

To inflate the upper packer 40 fluid, usually water, is pumped through line 34 at a pressure less than 300 psi. After pumping a sufficient volume of fluid to inflate the upper packer 40, the system is closed in and checked for leaks, which will be indicated by a loss of control system pressure. If no leaks are found, the lower packer 40 is inflated by raising the fluid pumping pressure in line 34 above 300 psi but less than 400 psi thereby shearing the shear pin 135 in the lower packer inflation control valve 120 allowing fluid to enter the packer 40 through branch line 38. At this time, the system is again closed in and checked for leaks. If there are no leaks, the fluid pressure is increased above 400 psi in the line 34 thereby shearing the shear pin 135 in the grout control valve 120. When the grout control valve 120 opens, the pressure in the line 34 will drop indicating the annulus between the pile sleeve 32 and the pile 20 is ready to receive the grout. At this time the pressure in the line 34 is released with the upper and lower packers 40 remaining inflated and sealingly engaging the pile 20 since the upper and lower packer check valves 70 prevent the fluid from the packers 40 flowing into the line 34. After the packers 40 have been inflated but before grout has been pumped into the annulus formed between the pile 20 and pile sleeve 32, the annulus formed between the pile 20 and pile sleeve 32 is cleared of any water and checked for leaks by injecting air or any suitable gas into the annulus through line 34 and branch line 37 with the water flowing out the grout return line 35 to the surface 33 of the offshore platform 30. Subsequently, grouting material is injected into the annulus formed by pile sleeve 32 and 20 through line 34 and branch line 37 with the excess grouting material flowing to the surface 33 of the platform 30 via grout return line 35. It will be understood that the annulus between the pile sleeve 32 and the pile 20 may be vented to allow the escape of the air of any suitable gas used to clear the annulus before the injection of grouting material therein or the annulus may be grouted without venting the annulus. Furthermore, while the air pressure in the annulus is normally released or vented to atmospheric pressure, it could be released to any desired pressure level. If an amount of water remained in the annulus and diluted the grouting material being pumped into the annuli, grouting can be pumped into the annulus until such time as the grouting flowing out the grout return line 35 at the platform surface 33 is the same quality as the grouting being pumped into the annuli.

By using a packer at both the top and bottom of the pile sleeves 32 on the platform 30, an improved grouting method results since it is not necessary to maintain the annuli in the pile sleeves under pressure until the grout hardens to insure water surrounding the pile sleeves does not dilute the grouting material, it can be readily ascertained whether or not the annuli are free of water to insure no dilution of the grouting material and it is not necessary to pump large quantities of grouting material into the slit on the ocean floor surrounding the pile sleeves to insure that the annuli in pile sleeves have been filled with grouting material.

While the invention herein regarding the inflatable packers, control valve system and methods of grouting the pile sleeve of offshore platforms have been described with reference to preferred embodiments, it will be appreciated by those skilled in the art that additions, deletions, modifications and substitutions, or other changes not specifically described may be made which fall within the purview of the appended claims.

What is claimed is:

1. A control valve system controlling the inflation fluid pressure and flow during the inflation of an upper packer and a lower packer contained within a pile sleeve and controlling grouting material flow and pressure during the grouting of the annulus formed between said pile sleeve and a pile driven therethrough, said control valve system utilizing a single line to supply the inflation fluid and the grouting material to a plurality of pile sleeves comprising:

upper packer inflation control valve means controlling the pressure at which fluid flows into said upper packer;

upper packer inflation check valve means connected to said upper packer inflation control valve means preventing said inflation fluid flow from said upper packer after the inflation thereof;

lower packer inflation check valve means preventing said inflation fluid flow from said lower packer after the inflation thereof; and grout control valve means controlling the pressure at which the grouting material flows into said annulus between said pile sleeve and said pile.

2. The control valve system of claim 1 further comprising grout check valve means connected to said grout control valve preventing said grouting material flow from said annulus between said pile sleeve and said pile after the grouting thereof.

3. The control valve system of claim 1 further comprising valve means controlling said inflation fluid flow and said grouting material flow to individual pile sleeves of said plurality of pile sleeves whereby said inflation fluid flow and said grouting material flow is initially directed by said valve means to one pile sleeve of said plurality of pile sleeves and upon actuation of said valve means said inflation fluid flow and said grouting material flow is prevented from flowing to said one of said plurality of pile sleeves and directed by said valve means to another pile sleeve of said plurality of pile sleeves.

4. The control valve system of claim 3 wherein said valve means controlling said inflation fluid flow and said grout material flow to a plurality of pile sleeves comprises a sleeve valve.

5. The control valve system of claim 1 further comprising pressure relief valve means for controlling the maximum inflation fluid pressure and the maximum grouting material pressure in said control valve system.

6. A control valve system controlling the inflation fluid pressure and flow during the inflation of an upper packer and a lower packer contained within a pile sleeve and controlling grouting material flow and pressure during the grouting of the annulus formed between said pile sleeve and a pile driven therethrough, said control valve system utilizing a single line to supply the inflation fluid and the grouting material to a plurality of pile sleeves comprising:

upper packer inflation control valve means controlling the pressure at which fluid flows into said upper packer;

upper packer inflation check valve means connected to said upper packer inflation fluid flow from said upper packer after inflation thereof;

lower packer inflation check valve means preventing said inflation fluid flow from said lower packer after the inflation thereof;

grout control valve means controlling the pressure at which the grouting material flows into said annulus between said pile sleeve and said pile;

grout check valve means connected to said grout control valve means preventing said grouting material flow from said annulus between said pile sleeve and said pile after the grouting thereof;

valve means controlling said inflation fluid flow and said grouting material flow to individual pile sleeves of said plurality of pile sleeves whereby said inflation fluid flow and said grouting material flow is initially directed by said valve means to one pile sleeve of said plurality of pile sleeves and upon actuation of said valve means said inflation fluid flow and said grouting material flow is prevented from flowing to said one of said plurality of pile sleeves and directed by said valve means to another pile sleeve of said plurality of pile sleeves; and pressure relief valve means controlling the maximum inflation fluid pressure and the maximum grouting material pressure in said control valve system.

7. A control valve system controlling the inflation fluid pressure and flow during the inflation of an upper packer and a lower packer contained within a pile sleeve and controlling grouting material flow and pressure during the grouting of the annulus formed between said pile sleeve and a pile driven therethrough, said control valve system utilizing a single line to supply the inflation fluid and the grouting material comprising:

upper packer inflation control valve means controlling the pressure at which fluid flows into said upper packer;

upper packer inflation check valve means connected to said upper packer inflation control valve means preventing said inflation fluid flow from said upper packer after the inflation thereof;

lower packer inflation check valve means preventing said inflation fluid flow from said lower packer after the inflation thereof;

grout control valve means controlling the pressure at which the grouting material flows into said annulus between said pile sleeve and said pile;

grout check valve means connected to said grout control valve means preventing said grouting material flow from said annulus between said pile sleeve and said pile after the grouting thereof; and pressure relief valve means controlling the maximum inflation fluid pressure and the maximum grouting material pressure in said control valve system.

8. A control valve system controlling the inflation fluid pressure and flow during the inflation of an upper packer and a lower packer contained within a pile sleeve and controlling grouting material flow and pressure during the grouting of the annulus formed between said pile sleeve and a pile driven therethrough, said control valve system utilizing a single line to supply the inflation fluid and the grouting material comprising:

upper packer inflation check valve means preventing said inflation fluid flow from said upper packer after the inflation thereof;

lower packer inflation control valve means controlling the pressure at which fluid flows into said lower packer;

lower packer inflation check valve means connected to said lower packer inflation control valve means preventing said inflation flow from said lower packer after the inflation thereof; and grout control valve means controlling the pressure at which the grouting material flows into said annulus between said pile sleeve and said pile.

9. A control valve system controlling the inflation fluid pressure and flow during the inflation of an upper packer and a lower packer contained within a pile sleeve and controlling grouting material flow and pressure during grouting of the annulus formed between said pile sleeve and a pile driven therethrough, said control valve system utilizng a single line to supply the inflation fluid and the grouting material comprising:

upper packer inflation check valve means preventing said inflation fluid flow from said upper packer after the inflation thereof;

lower packer inflation control valve means controlling the pressure at which fluid flows into said lower packer;

lower packer inflation check valve means connected to said lower packer inflation control valve means preventing said inflation fluid flow from said lower packer after the inflation thereof;

grout control valve means controlling the pressure at which the grouting material flows into said annulus between said pile sleeve and said pile; and pressure relief valve means controlling the maximum inflation fluid pressure and the maximum grouting material pressure in said control valve system.

10. A control valve system controlling the inflation fluid pressure and flow during the inflation of an upper packer and a lower packer contained within a pile sleeve and controlling grouting material flow and pressure during the grouting of the annulus formed between said pile sleeve and a pile driven therethrough, said control valve system utilizing a single line to supply the inflation fluid and the grouting material to a plurality of pile sleeves comprising:

upper packer inflation check valve means preventing said inflation fluid flow from said upper packer after the inflation thereof;

lower packer inflation control valve means controlling the pressure at which fluid flows into said lower packer;

lower packer inflation check valve means connected to said lower packer inflation control valve means preventing said inflation fluid flow from said lower packer after the inflation thereof; and grout control valve means controlling the pressure at which the grouting material flows into said annulus between said pile sleeve and said pile.

11. The control valve system of claim 10 further comprising grout check valve means connected to said grout control valve preventing said grouting material flow from said annulus between said pile sleeve and said pile after the grouting thereof.

12. The control valve system of claim 10 further comprising valve means controlling said inflation fluid flow and said grouting material flow to individual pile sleeves of said plurality of pile sleeves whereby said inflation fluid flow and said grouting material flow is initially directed by said valve means to one pile sleeve of said plurality of pile sleeves and upon actuation of said valve means said inflation fluid flow and said grouting material flow is prevented from flowing to said one of said plurality of pile sleeves and directed by said valve means to another pile sleeve of said plurality of pile sleeves.

13. The control valve system of claim 12 wherein said valve means controlling said inflation fluid flow and said grout material flow to a plurality of pile sleeves comprises a sleeve valve.

14. The control valve system of claim 10 further comprising pressure relief valve means for controlling the maximum inflation fluid pressure and the maximum grouting material pressure in said control valve system.

15. A method of grouting a plurality of annuli formed by a plurality of pile sleeves having piles driven therethrough, utilizing a control valve system controlling the inflation fluid pressure and flow during the inflation of an upper packer installed at the top of each pile sleeve having a pile driven therethrough and a lower packer installed at the bottom of each pile sleeve having a pile driven therethrough and controlling grouting material flow and pressure during the grouting of each annulus formed by a pile sleeve having a pile driven therethrough, said control valve system having a single line to supply the inflation fluid and grouting material to said plurality of pile sleeves having piles driven therethrough and comprising upper pcker inflation control valve means, upper packer inflation check valve means, lower packer inflation check valve means, grout control valve means and grout check valve means for each pile sleeve, sleeve valve means, and pressure relief valve means, said method comprising the steps of:

sealing the bottom of an annulus formed by a first pile sleeve having a pile driven therethrough by inflating said lower packer utilizing said single line to supply said inflation fluid at a first pressure level to said lower packer;

sealing the top of an annulus formed by a first pile sleeve having a pile driven therethrough by inflating said upper packer utilizing said single line to supply said inflation fluid at a second pressure level to open said upper packer inflation control valve means allowing said inflation fluid to flow therethrough to inflate said upper packer;

applying pressure at a third pressure level to said grout control valve means connected to a first pile sleeve having a pile driven therethrough utilizing said single line until said grout control valve means opens thereby allowing communications of the annulus formed by a first pile sleeve having a pile driven therethrough with said single line; and injecting grouting material into the annulus formed by a fist pile sleeve, having a pile driven therethrough utilizing said single line to supply said grouting material.

16. The method of claim 15 further comprising the steps of:

preventing said inflation fluid flow from said lower packer by said lower packer inflation check valve means;

preventing said inflation fluid flow from said upper packer by said upper packer inflation check valve means; and preventing the over-inflation of said upper packer and said lower packer by said pressure relief valve means.

17. The method of claim 15 further comprising the step of:

preventing the flow of said grouting material from the annulus formed by a first pile sleeve having a pile driven therethrough utilizing said grout check valve means.

18. The method of claim 15 further comprising the step of:

actuating said sleeve valve means to control the flow of said inflation fluid and said grouting material to another annulus formed by a pile sleeve having a pile driven therethrough of said plurality of pile sleeves.

19. The method of claim 15 further comprising the step of:

injecting a gas into the annulus formed by a first pile sleeve having a pile driven therethrough between said upper packer and said lower packer after the inflation thereof to expel any material contained within the annulus before injecting said grouting material into the annulus.

20. A method of grouting a plurality of annuli formed by a plurality of pile sleeves having piles driven therethrough, utilizing a control valve system controlling the inflation fluid pressure and flow during the inflation of an upper packer installed at the top of each pile sleeve having a pile driven therethrough and a lower packer installed at the bottom of each pile sleeve having a pile driven therethrough and controlling grouting material flow and pressure during the grouting of each annulus formed by a pile sleeve having a pile driven therethrough, said control valve system having a single line to supply the inflation fluid and grouting material to said plurality of pile sleeves having piles driven therethrough and comprising upper packer inflation control valve means, upper packer inflation check valve means, lower packer inflation check valve means, grout control valve means and grout check valve means for each pile sleeve, sleeve valve means, and pressure relief valve means, said method comprising the steps of:

sealing the bottom of an annulus formed by a first pile sleeve by inflating said lower packer utilizing said single line to supply said inflation fluid at a first pressure level to said lower packer;

preventing said inflation fluid flow from said lower packer after the inflation thereof by said lower packer inflation check valve means;

sealing the top of an annulus formed by a first pile sleeve having a pile driven therethrough utilizing said single line to supply said inflation fluid at a second pressure level to open said upper packer inflation control valve means allowing said inflation fluid to flow therethrough to inflate said upper packer;

preventing said inflation fluid flow from said upper packer after the inflation thereof by said upper packer inflation check valve means;

applying pressure at a third pressure level to said grout control valve means connected to a first pile sleeve having a pile driven therethrough utilizing said single line until said grout control valve means opens thereby allowing communication of the annulus formed by a first pile sleeve having a pile driven therethrough with said single line;

injecting grouting material into the annulus formed by a first pile sleeve having a pile driven therethrough utilizing said single line;

preventing the flow of said grouting material from the annulus formed by a first pile sleeve having a pile driven therethrough utilizing said grout check valve means after the injection of grouting material into said annulus; and actuating said sleeve valve means to control the flow of said inflation fluid and said grouting material to another annulus formed by a pile sleeve having a pile driven therethrough of said plurality of pile sleeves.

21. A method of grouting a plurality of annuli formed by a plurality of pile sleeves having piles driven therethrough, utilizing a control valve system controlling the inflation fluid pressure and flow during the inflation of an upper packer installed at the top of each pile sleeve having a pile driven therethrough and a lower packer installed at the bottom of each pile sleeve having a pile driven therethrough and controlling grouting material flow and pressure during the grouting of each annulus formed by a first pile sleeve having a pile driven therethrough, said control valve system having a single line to supply the inflation fluid and grouting material to said plurality of pile sleeves having piles driven therethrough and comprising an upper packer inflation check valve means, lower packer inflation control valve means, lower packer inflation check valve means, grout control valve means and grout check valve means for each pile sleeve, sleeve valve means and pressure relief valve means, said method comprising the steps of:

sealing the top of an annulus formed by a first pile sleeve having a pile driven therethrough by inflating said upper packer utilizing said single line to supply said inflation fluid at a first pressure level to said upper packer;

sealing the bottom of an annulus formed by a first pile sleeve having a pile driven therethrough utilizing said single line to supply said inflation fluid at a second pressure level to open said lower packer inflation control valve means allowing said inflation fluid to flow therethrough to inflate said lower packer;

applying pressure at a third pressure level to said grout control valve means connected to a first pile sleeve having a pile driven therethrough utilizing said single line until said grout control valve means opens thereby allowing communication of the annulus formed by a first pile sleeve having a pile driven therethrough with said single line; and injecting grouting material into the annulus formed by a first pile sleeve having a pile driven therethrough utilizing said single line.

22. The method of claim 21 further comprising the steps of:

preventing said inflation fluid flow from said upper packer by said upper packer inflation check valve means; and preventing said inflation fluid flow from said lower packer by said lower packer inflation check valve means.

23. The method of claim 21 further comprising the step of:

preventing the flow of said grouting material from the annulus formed by a first pile sleeve having a pile driven therethrough by said grout check valve means.

24. The method of claim 21 further comprising the step of:

actuating said sleeve valve means to control the flow of said inflation fluid and said grouting material to another annulus formed by a pile sleeve having a pile driven therethrough of said plurality of pile sleeves having piles driven therethrough.

25. The method of claim 21 further comprising the step of:

injecting a gas into the annulus formed by a first pile sleeve having a pile driven therethrough between said upper packer and said lower packer after the inflation thereof to expel any material contained within the annulus before injecting said grouting material into the annulus.

26. The method of claim 21 further comprising the step of:

injecting a gas into the annulus formed by a first pile sleeve having a pile driven therethrough between said upper packer and said lower packer after the inflation of said upper packer but before the inflation of said lower packer to expel any material contained within the annulus.

27. A method of grouting an annulus formed by a pile sleeve having a pile driven therethrough, utilizing a control valve system controlling the inflation fluid pressure and flow during the inflation of an upper packer installed at the top of said pile sleeve and a lower packer installed at the bottom of said pile sleeve and controlling grouting material pressure and flow during the grouting of said annulus, said control valve system having a single line to supply the inflation fluid and the grouting material, said method comprising the steps of:

sealing the bottom of said annulus formed by said pile sleeve having a pile driven therethrough by inflating said lower packer utilizing said single line to supply said inflation fluid at a first pressure level to said lower packer;

sealing the top of said annulus formed by said pile sleeve having a pile driven therethrough by inflating said upper packer utilizing said single line to supply said inflation fluid at a second pressure level to open an upper packer inflation control valve means allowing said inflation fluid to flow therethrough to inflate said upper packer;

applying pressure at a third pressure level to a grout control valve means utilizing said single line until a grout control valve means opens thereby allowing communication of said annulus with said single line; and injecting grouting material into said annulus formed by said pile sleeve having a pile driven therethrough utilizing said single line to supply said grouting material.

28. The method of claim 27 further comprising the steps of:

preventing said inflation fluid flow from said lower packer by utilizing a lower packer inflation check valve means; and preventing said inflation fluid flow from said upper packer by utilizing an upper packer inflation check valve means.

29. The method of claim 27 further comprising the step of:

preventing the flow of said grouting material from said annulus by utilizing a grout check valve means.

30. The method of claim 27 further comprising the step of:

preventing the over-inflation of said upper packer and said lower packer by utilizing a pressure relief valve means in said single line.

31. The method of claim 27 further comprising the step of:

injecting a gas into said annulus formed by a pile sleeve having a pile driven therethrough between said upper packer and said lower packer after the inflation thereof to expel any material contained within said annulus before injecting said grouting material into said annulus.

32. A method of grouting an annulus formed by a pile sleeve having a pile driven therethrough, utilizing a control valve system controlling the inflation fluid pressure and flow during the inflation of an upper packer installed at the top of said pile sleeve and a lower packer installed at the bottom of said pile sleeve and controlling grouting material pressure and flow during the grouting of said annulus, said control valve system having a single line to supply the inflation fluid and the grouting material, said method comprising the steps of:

sealing the top of said annulus formed by said pile sleeve having a pile driven therethrough by inflating said upper packer utilizing said single line to supply said inflation fluid at a first pressure level to said upper packer;

sealing the bottom of said annulus formed by said pile sleeve having a pile driven therethrough by inflating said lower packer utilizing said single line to supply said inflation fluid at a second pressure level to open a lower packer inflation control valve means allowing said inflation fluid to flow therethrough to inflate said lower packer;

applying pressure at a third pressure level to a grout control valve means utilizing said single line until a grout control valve means opens thereby allowing communication of said annulus with said single line; and injecting grouting material into said annulus formed by said pile sleeve having a pile driven therethrough and the bottom of said pile sleeve utilizing said single line to supply said grouting material.

33. The method of claim 32 further comprising the steps of:

preventing said inflation fluid flow from said upper packer by utilizing an upper packer check valve means; and preventing said inflation fluid flow from said lower packer by utilizing a lower packer inflation check valve means.

34. The method of claim 32 further comprising the step of:

preventing the flow of said grouting material from said annulus by utilizing a grout check valve means.

35. The method of claim 32 further comprising the step of:

preventing the over-inflation of said upper packer and said lower packer by utilizing a pressure relief valve means in said single line.

36. The method of claim 32 further comprising the step of:

Injecting a gas into said annulus between said upper packer and said lower packer after the inflation thereof to expel any material contained within said annulus before injecting said grouting material into said annulus.

37. The method of claim 32 further comprising the step of:

injecting a gas into said annulus after the inflation of said upper packer but before the inflation of said lower packer to expel any material contained within said annulus before injecting said grouting material into said annulus.

38. A method of grouting a plurality of annuli formed by a plurality of pile sleeves having piles driven therethrough, utilizing a control valve system controlling the inflation fluid pressure and flow during the inflation of an upper packer installed at the top of each pile sleeve having a pile driven therethrough and a lower packer installed at the bottom of each pile sleeve having a pile driven therethrough and controlling grouting material flow and pressure during the grouting of each annulus formed by a pile sleeve having a pile driven therethrough, said control valve system having a single line to supply the inflation fluid and grouting material to said plurality of pile sleeves having piles driven therethrough and comprising upper packer inflation control valve means, upper packer inflation check valve means, lower packer inflation check valve means, grout control valve means and grout check valve means for each pile sleeve, valve means for controlling said inflation fluid flow and said grouting material flow to individual pile sleeves of said plurality of pile sleeves and pressure relief valve means, said method comprising the steps of:

sealing the bottom of an annulus formed by a first pile sleeve having a pile driven therethrough by inflating said lower packer utilizing said single line to supply said inflation fluid at a first pressure level to said lower packer;

sealing the top of an annulus formed by a first pile sleeve having a pile driven therethrough by inflating said upper packer utilizing said single line to supply said inflation fluid at a second pressure level to open said upper packer inflation control valve means allowing said inflation fluid to flow therethrough to inflate said upper packer;

applying pressure at a third pressure level to said grout control valve means connected to a first pile sleeve having a pile driven therethrough utilizing said single line until said grout control valve means opens thereby allowing communication of the annulus formed by a first pile sleeve having a pile driven therethrough with said single line; and injecting grouting material into the annulus formed by a first pile sleeve, having a pile driven therethrough utilizing said single line to supply said grouting material.

39. The method of claim 38 further comprising the steps of:

preventing said inflation fluid flow from said lower packer by said lower packer inflation check valve means;

preventing said inflation fluid flow from said upper packer by said upper packer inflation check valve means; and preventing the over-inflation of said upper packer and said lower packer by said pressure relief valve means.

40. The method of claim 38 further comprising the step of:

preventing the flow of said grouting material from the annulus formed by a first pile sleeve having a pile driven therethrough utilizing said grout check valve means.

41. The method of claim 38 further comprising the step of:

actuating said valve means to control the flow of said inflation fluid and said grouting material to another annulus formed by a pile sleeve having a pile driven therethrough of said plurality of pile sleeves.

42. The method of claim 38 further comprising the step of:

injecting a gas into the annulus formed by a first pile sleeve having a pile driven therethrough between said upper packer and said lower packer after the inflation thereof to expel any material contained within the annulus before injecting said grouting material into the annulus.

* * * * *